United States Patent [19]

Sakurai

[11] 4,381,539

[45] Apr. 26, 1983

[54] LIGHTING EQUIPMENT

[75] Inventor: Shoji Sakurai, Sakai, Japan

[73] Assignee: Matsushita Electric Works, Ltd., Kadoma, Japan

[21] Appl. No.: 266,146

[22] Filed: May 22, 1981

[30] Foreign Application Priority Data

May 29, 1980 [JP] Japan ..... 55-75031[U]

[51] Int. Cl.[3] ..... F21V 21/16

[52] U.S. Cl. ..... 362/285; 362/40; 362/319; 362/403

[58] Field of Search ..... 362/40, 285, 319, 403

[56] References Cited

U.S. PATENT DOCUMENTS 951,520 5/1909 Dodge et al. ..... 362/403

4,195,332 3/1980 Thompson ..... 362/403

FOREIGN PATENT DOCUMENTS 621433 6/1961 Italy ..... 362/319

*Primary Examiner*—Irwin Gluck

*Attorney, Agent, or Firm*—Cushman, Darby & Cushman

[57] ABSTRACT

A lighting equipment of pendant type comprising:

a plural number of strings strung between a principal body of the lighting equipment and a holding means from which the lighting equipment is to be suspended for suspending the principal body from the holding means such as a ceiling or a beam, a string winder for winding and paying out the plural number of strings in each other related manner for variation of distance from the ceiling to the principal body, the string winder being to be fixed either to the principal body or on the ceiling, string guiding means for guiding each string and disposed with a predetermined distance from each other, corresponding to the string winder.

The equipment has always desirable atitude in plan view aspect as well as in elevation view aspect.

17 Claims, 17 Drawing Figures

LIGHTING EQUIPMENT

BACKGROUND OF THE INVENTION

1. Field of the Invention

The present invention relates to an improvement in a lighting equipment of pendant type, which is provided with height level adjusting means.

2. Description of the Prior Art

There is a demand that height level or the distance between the ceiling and a lighting equipment of pendant type is variable in order to meet various purposes of lighting. There are several ways of the height adjustment means. But the conventional ways have the problem that when the height level is changed the direction of the lamp is likely to change resulting in undesirable effects in lighting and also in the view point of interior decoration.

SUMMARY OF THE INVENTION

Therefore the purpose of the present invention is to provide a lighting equipment capable of adjusting its height level with retaining direction of the lighting equipment as designed. The lighting equipment in accordance with the present invention also enables maintenance of its desired attitude irrespective of changing of the height level.

BRIEF EXPLANATION OF THE DRAWING

FIG. 12(*b*) is an exploded perspective views of some components of the string winder of FIG. 12(*a*).

DETAILED DESCRIPTION OF THE PREFERRED EMBODIMENTS

Figure 1:
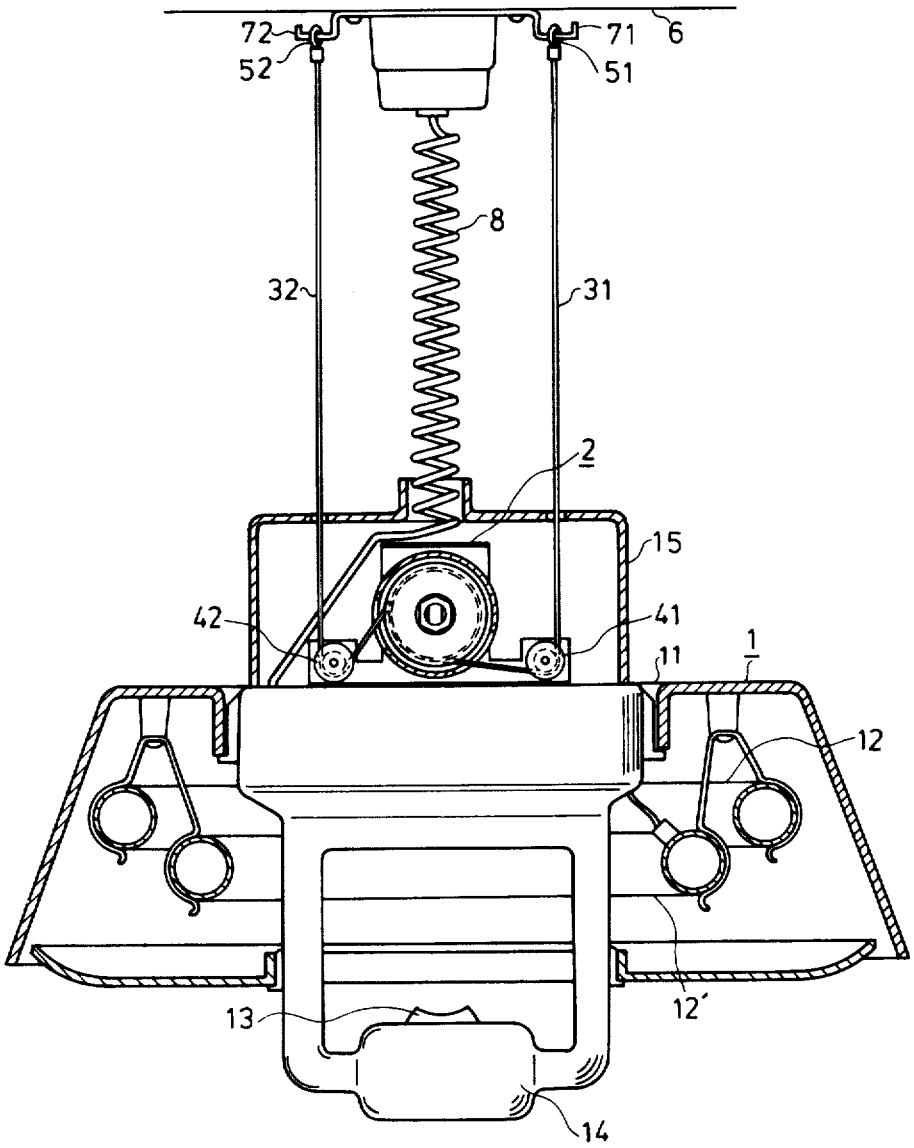
FIG. 1 is an elevational view, partly in cross section of an example lighting equipment of the present invention.

FIG. 1 is an elevational view, partly in cross section of lighting equipment of the present invention.

In FIG. 1, a string winder 2 is disposed on a back face (or upper side) of a shade 11 of a principal body or lighting fitting 1 substantially at the center of the back face of the shade 11, and the string winder 2 is covered by a case 15. Wires 31 and 32 as strings are wound on and paid out from the winder 2 and changed of their extending direction upward to the vertical direction respectively by pulley 41 and 42 as a guiding means. End loops 51 and 52 of the wires 31 and 32 are hung on hooks 71 and 72 which are fixed on a holding means 6, such as a ceiling or a beam, respectively. Electric power is supplied to the lighting fitting through a curl cord 8. The lighting fitting 1 has, for instance, two ring type or torodial fluorescent lamp 12, 12' and a handle 14 with a switch 13, the handle being for adjusting the height level of the lighting fitting therewith.

Figure 2:
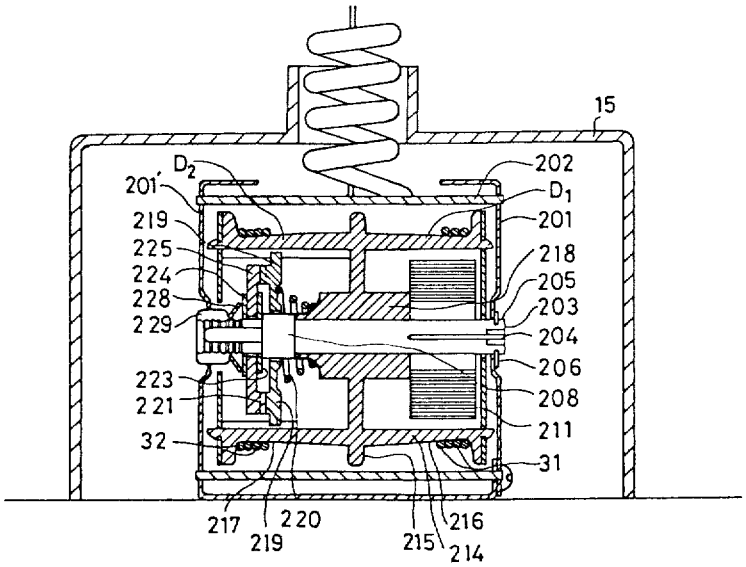
FIG. 2 is an enlarged vertical sectional side view of a string winder shown in FIG. 1.
Figure 3:
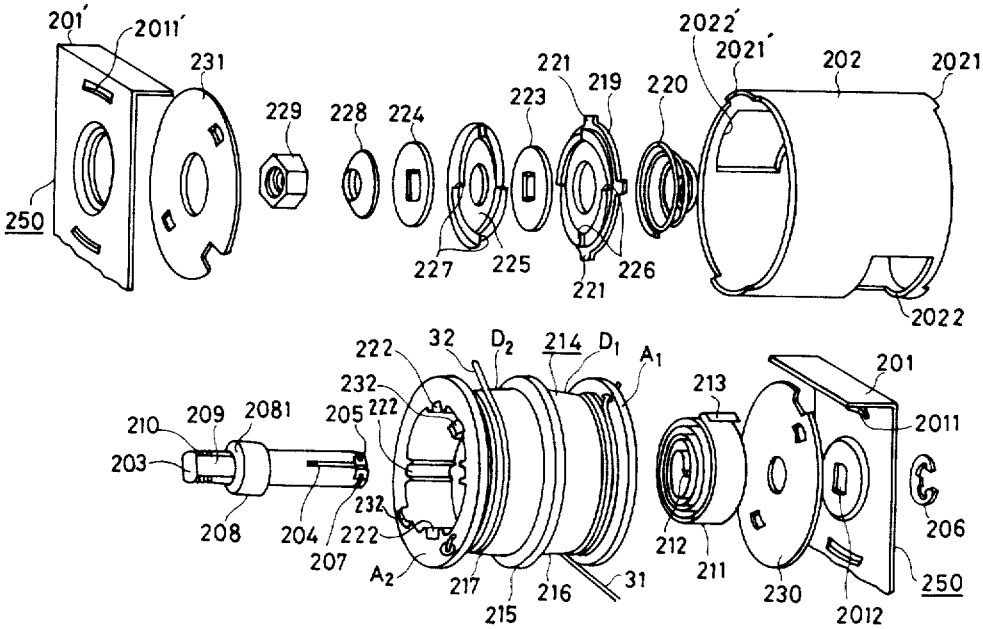
FIG. 3 is an exploded view of the string winder shown in FIG. 2.

FIG. 2 is an enlarged vertical sectional view of the string winder 2 shown in FIG. 1, and FIG. 3 is an exploded view of the string winder shown in FIG. 2.

In FIG. 2 and FIG. 3, the same numerals are employed to designate the corresponding parts.

In FIG. 2 and FIG. 3, a cylindrical casing 202 having openings 2022 and 2022' for passing strings 31, 32 is disposed between and held by two side plates 201, 201' of a chassis 250. A shaft 203 has a slot 204 which is milled in a direction parallel to the axial direction. An end part of the shaft 203 is formed as a small diameter and non-circular part 205 having a washer engaging slot 207, milled at a right angle to the shaft 203.

The non-circular part 205 of the shaft 203 is formed by milling lateral faces of the small diameter part 205 of the shaft 203 to form a pair of parallel flats, and the hole 2012 of the side plate 201 is formed to have of the same shape as that of the cross-section of the non-circular end part 205. Therefore the shaft 203 is non-rotatably fixed to the side plate 201. And the small diameter and non-circular part 205 is inserted into a non-circular hole 2012 on the side plate 201, further a split washer 206 is set in the washer engaging slot 207 of the small diameter and non-circular part 205. In the above-mentioned manner, the shaft 203 is fixed to the side plate 201. A large diameter part 208 is formed at a middle part of the shaft 203. A pair of lateral faces of the other end part 209 of the shaft 203 is milled to a pair of flats, and the end part 209 has a thread 210. A winding spring 211 has an inner hook 212 and an outer hook 213. The inner hook 212 is inserted and set in the slot 204 of the shaft 203, and the outer hook 213 is fixed to a slot (not shown) provided on an inner face of a integrated monoblock body 214, which consists of a first spool $D_1$, a second spool $D_2$ and a center separation flange 215 inbetween. The first and second spools $D_1$, $D_2$ have winding faces 216,217. The winding faces 216,217 are preferably truncated-cone shaped, namely in tapered drum shape. That is, the diameter of the drums are tapered from the center separation flange 215 to outside flanges $A_1$,$A_2$ of the monoblock spool 214. Wires 31 and 32 are wound on the winding faces 216,217 in the same direction, respectively. Ends of both wires 31,32 are fixed on the outside flanges $A_1$ and $A_2$, respectively. The monoblock spool 214 is rotatably held in the chassis 250 by pivotting the through-hole of its hub 218 on the shaft 203. A slide disk 219, having a center hole of a diameter suitable for slidable fitting on the large diameter part 208 of the shaft 203 is disposed in a inside hollow space of the monoblock spool 214 in a rotatable manner around the shaft 203. The slide disk 219 is pushed leftward by a compression spring 220 disposed between the disk 219 and the hub 218 along the shaft 203. Convex parts 221,221 are formed to protrude in radial direction of the slide disk 219. The convex parts 221,221 are slidably engaged in slots 222,222 formed on the inner face of the monoblock spool 214, so that the slide disk 219 can freely slide in axial direction. A rotor disk 225 is rotatably disposed between a first friction disk 223 and a second friction disk 224. The end part 209 of the shaft 203 penetrates the friction disks 223,224 and the rotor disk 225 in a manner that the friction disks 223,224 are not rotatable and only the rotor disk 225 is rotatable around the shaft 203. Ratchets 226,226 are formed at the rim of the slide disk 219. Ratchets 227,227 are formed at the rim of the rotor disk 225. The ratchets 226,226 of the slide disk 219 and the ratchets 227,227 of the rotor disk form know ratchet means. A disk spring 228 set by a nut 229 is disposed to push the second friction disk 224 leftwards, thereby to give a suitable friction to the rotor disk 225. Reinforcement disks 230 and 231 are disposed on the flanges $A_1$ and $A_2$ fixed by protrusions 232,232 on the face of the franges $A_1$ and $A_2$ to reinforce the spools $D_1$ and $D_2$.

Then an operation of the apparatus shown in FIG. 1, FIG. 2 and FIG. 3 will be explained hereinafter.

[Pull down motion]:

When the handle 14 of the lighting fitting 1 is pulled down, the wires 31,32 are veered out from the spools $D_1$,$D_2$, and hence the slide disk 219 rotates together with the monoblock spool 214. As the slide disk 219 rotates, the ratchets 226,226 which are engaging to the ratchets 227,227 on the rotor disk 225 causes the rotor disk 225 to rotate, the rotating motion of the monoblock spool 214 is appropriately friction-controlled by the friction disks 223 and 224, and at the same time the spring 211 is wound up.

When the operator leaves the handle 14 when the lighting fitting 1 comes to a desired height level, the lighting fitting maintains the desired height level since a considerable friction force is given to the rotating motion of the rotor disk 225 by the first and second friction disks 223,224.

[Push up motion]:

And then, when the handle 14 is pushed up, a reverse rotating force to the above-mentioned operation is impressed to the monoblock spool 214 by means of the winding up spring 211.

In this upward movement of the lighting fitting, the relative rotation of the ratchets 226,226 and of the ratchets 227,227 are in the direction to disengage the gearing of the ratchet 226 and 227. Therefore, the friction force by the first and the second friction disks 223 and 224 is not impressed on the slide disk, and hence on the monoblock spool 214. In this motion, by the spring force of the compression spring 220, the slide disk 219 is once pushed leftward in FIG. 3 into the monoblock spool 214, and then the disk 219 slides back rightwards. Consequently the slide disk 219 reciprocates sliding in the monoblock spool 214. Therefore, the monoblock spool 214 needs not make reciprocating motion, in the ratchetting motion but only makes rotation. Accordingly the windings of the strings 31 and 32 are made in good order. And then, when the operator leaves the handle 14, the lighting fitting 1 maintains its height level as likely above-mentioned manner.

In the apparatus shown in FIG. 1, FIG. 2 and FIG. 3, an axial motion of the monoblock spool 214 can be perfectly prevented. Therefore the wires 31,32 are wound on the respective winding faces 216,217 of the first and second spool $D_1$ and $D_2$ in an orderly manner, and the wires 31,32 hardly get twisted round or overlaps. Consequently the veering-out length of the strings or wires 31,32 can be always equal each other, and therefore the attitude of the lighting fitting 1 can be maintained horizontally without particular horizontal adjustment means. Particularly in the embodiment of present invention the winding faces 216,217 are formed in tapered drum shapes as shown in FIGS. 2 and 3, and hence, as the winding of the wire proceeds the wires 31,32 are guided in order towards the portions of the separation flange 215, which is formed on the most large diameter portion of the monoblock spool 214. Ends of the wires 31,32 are fixed on respective end flanges $A_1$ and $A_2$. Therefore the wires 31,32 are wound from respective end flanges $A_1$ and $A_2$ to the center separation flange 215 with certainty and in an orderly manner. The tapering of the winding face is most effective when the tapering angle between the winding face and the axis of the spool is 0.5 degree to 2.0 degree. The upper and lower ends of the wires 31,32 are fixed on the ceiling 6, and on the lighting fitting 1 with a predetermined horizontal distance inbetween. Therefore, undesirable rotating motion in a holizontal plane of the lighting fitting 1 can be perfectly prevented, and further a shaking motion in sideways can be prevented. Consequently a variety of developments of design of a lighting fitting can be realized. For instance, an attitude of a square or oblong shade can be maintained in a designed state.

Figure 4:
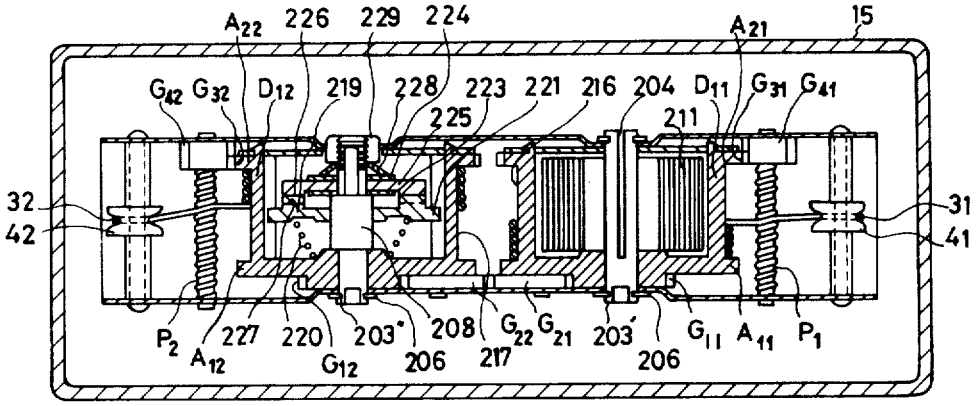
FIG. 4 is a partially sectional plan view of a string winder and a guiding means of another embodiment of present invention.

FIG. 4 is a partially sectional plan view of a string winder and a guiding means of another embodiment of present invention.

Figure 5:
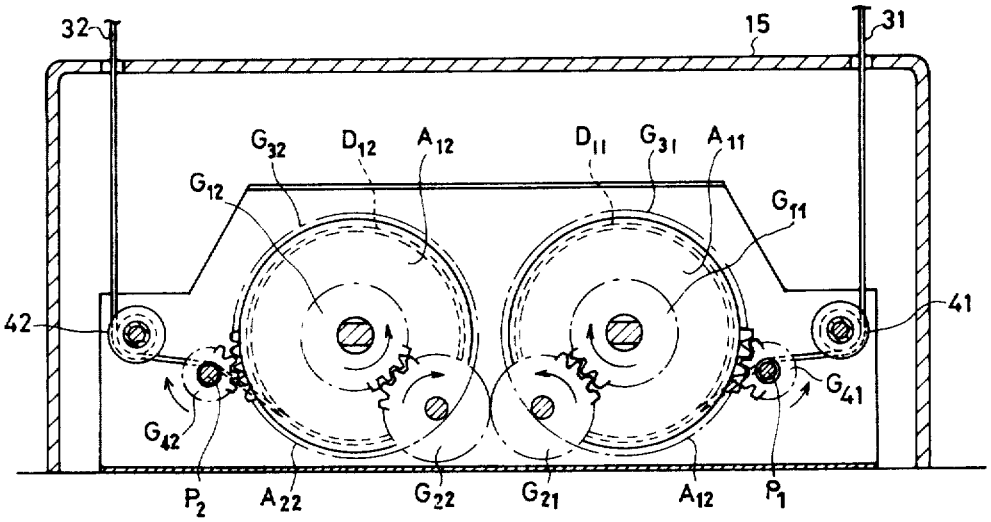
FIG. 5 is a side view of the train of gearing of the structure shown in FIG. 4.

FIG. 5 is a side view showing train of gearing of the structure shown in FIG. 4.

In FIG. 4 and FIG. 5, the same numerals are employed to designate the parts corresponding to FIG. 2 and FIG. 3, and detailed explanation about the parts are omitted.

In FIG. 4 and FIG. 5, a first spool $D_{11}$ of a drum shape and a second spool $D_{12}$ of a drum shape are journaled with respective shafts 203' and 203''. A gear $G_{11}$ of a smaller diameter than a flange $A_{11}$ of the spool $D_{11}$ is provided in a manner that the gear $G_{11}$ and the flange $A_{11}$ form an integral part. Also a gear $G_{12}$ is disposed on the flange $A_{12}$ of the spool $D_{12}$ in the same manner as the gear $G_{11}$. A gear $G_{21}$ of the same diameter of the gear $G_{11}$ is provided for gearing with it. A gear $G_{22}$ of the same diameter of the gear $G_{21}$ is provided for gearing with it. The gear $G_{21}$ and $G_{22}$ are disposed in a manner that the gears $G_{21}$ and $G_{22}$ are geared each other. A gear train is structured by the gears $G_{11}$, $G_{21}$, $G_{22}$, and $G_{12}$. Accordingly, the first spool $D_{11}$ and the second spool $D_{12}$ rotate synchronously with each other. A gear $G_{31}$ is formed at a rim part of the other flange $A_{21}$ of the spool $D_{11}$ by milling the gear teeth thereon.

A gear $G_{32}$ is formed at a rim part of the other flange $A_{22}$ of the spool $D_{12}$ by milling the gear teeth thereon. A relatively small gear or pinion $G_{41}$ is disposed for gearing with the gear $G_{31}$. And also a relatively small gear or pinion $G_{42}$ is disposed for gearing with the gear $G_{32}$. A shaft $P_1$ of the gear $G_{41}$ and a shaft $P_2$ of the gear $G_{42}$ are formed as screw shafts, which rotate with respective gear $G_{41}$, $G_{42}$. A wire 31 is guided by the pulley 41 to the first spool $D_{11}$, and is guided by the thread on the shaft $P_1$ and, so that the string 31 is guided in the right direction to the winding face of the spool $D_{11}$ so as to assure orderly aligned winding. A wire 32 is guided by the pulley 42 to the second spool $D_{12}$, and is guided by thread on the shaft $P_2$, so that the string 32 is guided in the right direction to the winding face of the spool $D_{12}$ so as to assure orderly aligned winding. The screwed shaft $P_1$ and the gears $G_{41}$, $G_{31}$ compose a string positioning means for regulating the winding position of the wire 31. The shaft $P_2$ and the gears $G_{42}$,$G_{32}$ compose a positioning means for regulating the winding position of the wire 32. Since the wires 31 and 32 are engaging on the threads on the screwed shafts $P_1$ and $P_2$ of above-mentioned positioning means, the engaging positions of the strings on the screwed shafts advance by rotations of the screwed shafts $P_1$ and $P_2$, respectively. In an apparatus shown in FIG. 4 and FIG. 5, the rotation of the first spool $D_{11}$ and the second spool $D_{12}$ are synchronized by the gear train $G_{11}$, $G_{21}$, $G_{22}$ and $G_{12}$. In changing the height level of the lighting fitting, since the diameters of the spools $D_{11}$ and $D_{12}$ are equal, the veering-out length of the wires 31,32 can be maintained always equal each other.

Figure 6:
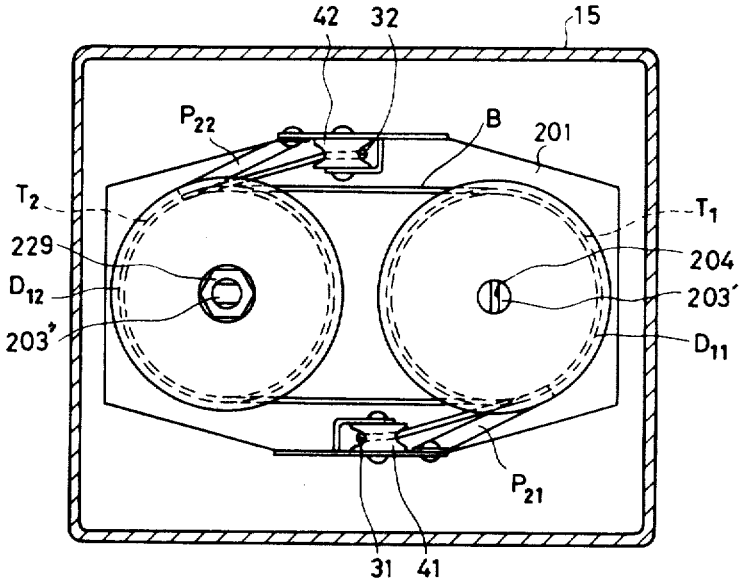
FIG. 6 is a plan view of a string winder and a guiding means of another embodiment of present invention.
Figure 7:
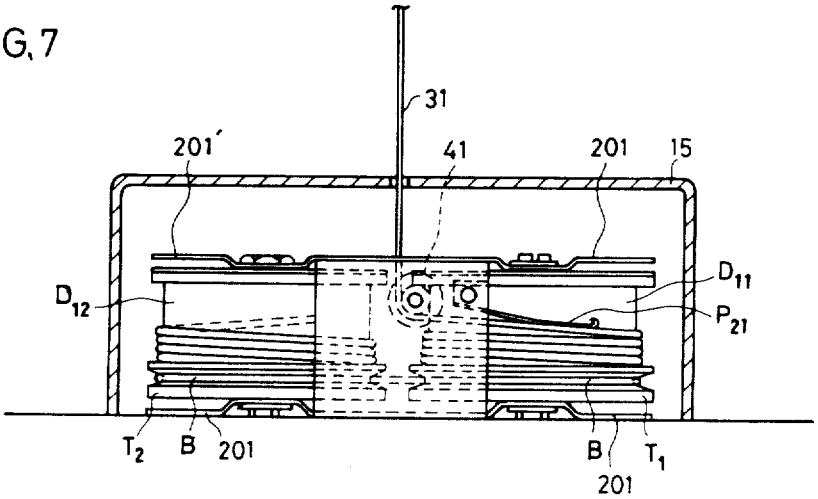
FIG. 7 is a side view of the string winder and the guiding means shown in FIG. 6.

FIG. 6 is a plan view of a string winder and a guiding means of another embodiment of the present invention, and FIG. 7 is a side view of the string winder and the guiding means of shown in FIG. 6. In these drawings, parts corresponding to those of FIGS. 2, 3 and 4 are designated by the same numerals as those, and description thereof are omitted.

A first spool $D_{11}$ and a second spool $D_{12}$ are journaled by vertical shafts 203' and 203", respectively. Both the first spool $D_{11}$ and the second spool $D_{12}$ have belt pulleys $T_1$ and $T_2$ of the substantially the same sizes with each other, respectively. A belt B is provided to link the first and the second pulleys $T_1$ and $T_2$ with each other. A first flat spring $P_{21}$ and a second flat spring $P_{22}$ are disposed in a manner to press down the wound strings 31 and 32 on the spools $D_{11}$ and $D_{12}$, respectively, the flat springs $P_{21}$ and $P_{22}$ constituting wound string positioning means.

By means of the belt B linking the belt pulleys $T_1$ and $T_2$, the rotations of the spools $D_{11}$ and $D_{12}$ are completely synchronized, and therefore, winding and paying out of the strings 31 and 32 can be made completely of the same length. Besides, by means of the wound string positioning means $P_{21}$ and $P_{22}$ the windings are very orderly, and hence the attitude of the lighting fitting can be made always constant irrespective of its change of height level.

Figure 8:
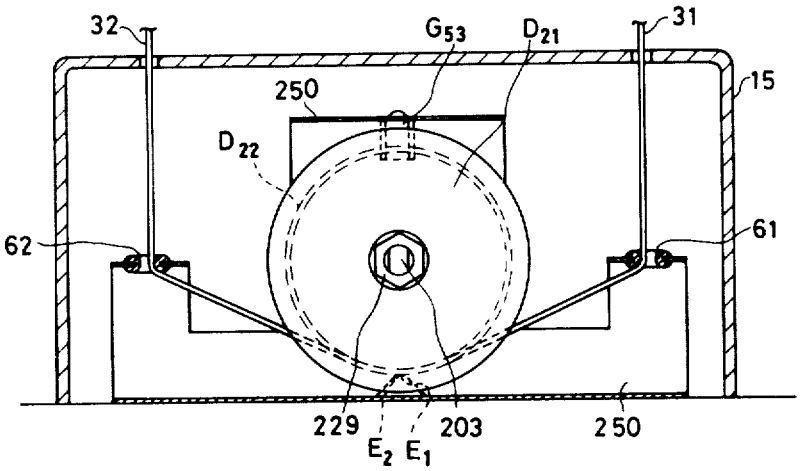
FIG. 8 is an elevational view of a string winder and a guiding means of another embodiment of present invention.
Figure 9:
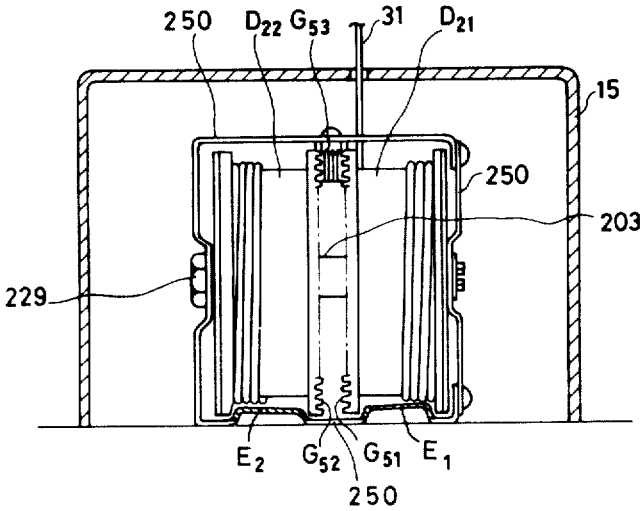
FIG. 9 is a side view of the string winder shown in FIG. 8.

FIG. 8 is an elevational views of a string winder and guiding means of another embodiment of the present invention, and FIG. 9 is a side view of the string winder shown in FIG. 8. In these drawings, parts corresponding to those of FIGS. 2, 3 and 4 are designated by the same numerals as those, and descriptions thereof are omitted.

A first spool $D_{21}$ and a second spool $D_{22}$ are journaled on a common horizontally disposed shaft 203, which is fixed on one end thereof to a chasis 250. Face gears $G_{51}$ and $G_{52}$ are fixed on the each-other-opposing faces of the spools $D_{21}$ and $D_{22}$, respectively, and an idler gear $G_{53}$ is provided between the two face gears $G_{51}$ and $G_{53}$ in a manner to engage and link the face gears $G_{51}$ and $G_{52}$ therewith. By means of the linking by the idler gear $G_{53}$, the rotations of the face gears $G_{51}$ and $G_{52}$, hence the rotations of the first spools $D_{21}$ and the second spool $D_{22}$ become opposite and synchronized each other. Therefore, the strings 31 and 32, which are led to the spools $D_{21}$ and $D_{22}$ in a manner to be wound in the opposite direction from each other, are synchronized in winding or paying-out of the spools $D_{21}$ and $D_{22}$, respectively. The strings 31 and 32 led out of the spools $D_{21}$ and $D_{22}$ are led upwards after passing the guiding means 61 and 62, respectively. The guiding means 61 and 62 are smoothly finished guiding rings made of, for example, a fluorine-containing synthetic resin. Bottom part of the chasis 250 is shaped to be raised upwards as shown in FIG. 9, thereby forming slackening-prevention means $E_1$ and $E_2$, which are disposed closely to the winding faces of the spools $D_{21}$ and $D_{22}$ thereby forming a very narrow gaps between them and the winding faces of the spool, respectively. The slackening-prevention means $E_1$ and $E_2$ serves to prevent slackening of strings 31 and 32 by guiding them to be aligned into a single layered winding in the narrow gaps. It is preferable that the paths of the strings 31 and 32 seen in the elevational view of FIG. 8 should be equal each other, and the fixing point of the strings 31 and 32 to the spools $D_{21}$ and $D_{22}$ should be also similar, and then, both strings 31 and 32 have the same length and hence even when the strings 31 and 32 are entirely paid out the total lengths of the wires 31 and 32 become equal each other. Therefore the attitude of the lighting fitting does not change even at the lowest level of its height adjustment.

Figure 10:
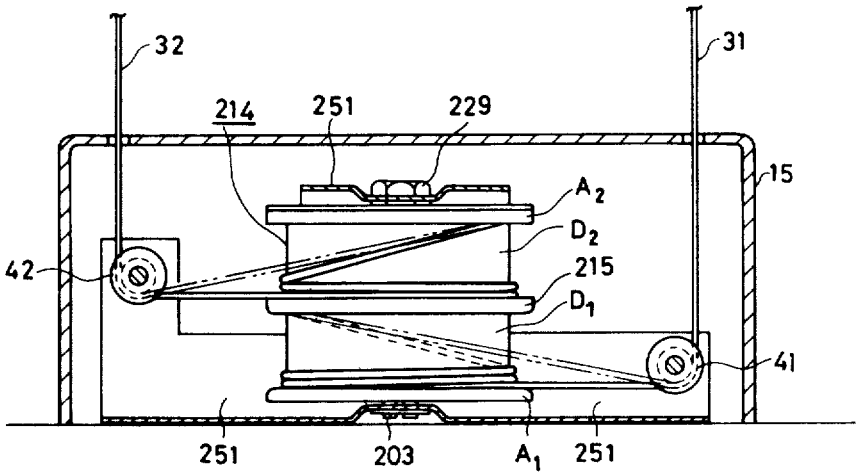
FIG. 10 is an elevational view of a string winder and a guiding means of another embodiment of present invention.
Figure 11:
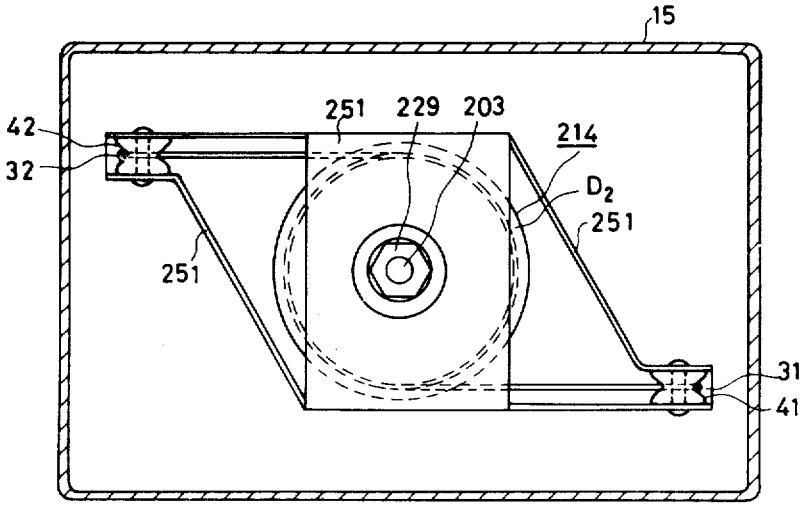
FIG. 11 is a plan view of the string winder and the guiding means shown in FIG. 10.

FIG. 10 is an elevation view of a string winder and a guiding means of another embodiment of the present invention and FIG. 11 is a plan view of the string winder and the guiding means of FIG. 10. In these drawings, corresponding parts to those of FIGS. 2, 3 and 4 are designated by the same numerals as those, and description thereof are omitted.

Spools $D_1$ and $D_2$ are formed as a monoblock spool 214 with a central separation flange 215, and the monoblock spool 214 is journaled by a vertical shaft 203 which is fixed on a chasis 251. A pulley 41 for guiding a string 31 from the lower spool $D_1$ is disposed at such a position of substantially the same height level as that of the lower end flange $A_1$. After passing the pulley 41, the string 31 is led upwards to the ceiling or frame in a high place. Another pulley 42 for a string 32 from the lower spool $D_1$ is disposed at such a position of substantially the same height level as that of the central separation flange 215. After passing the pulley 42, the string 32 is led upwards to the ceiling or the frame in the high place. An end of the first string 31 to be wound on the first pulley $D_1$ is fixed at a foot of the central separation flange 215. An end of the second string 32 to be wound on the second pulley $D_2$ is fixed at a foot of the upper end flange $A_2$. In a plan view arrangement, the pulleys 41 and 42 are disposed on a tangential line of the winding surface of the spools $D_1$ and $D_2$.

In the example of FIGS. 10 and 11, the ends of wires 31 and 32 are fixed on the high parts in the respective spools $D_1$ and $D_2$, and the pulleys 41 and 42 for the strings 31 and 32 are disposed on the lower part with respect to the spools $D_1$ and $D_2$, respectively. Therefore, the winding of the strings 31 and 32 on the spools $D_1$ and $D_2$ are made in a very good order from the upper end to the lower end thereof. This orderly winding and veering attains accurately balanced string length resulting in maintaining good attitude of the lighting fitting.

Figure 12B:
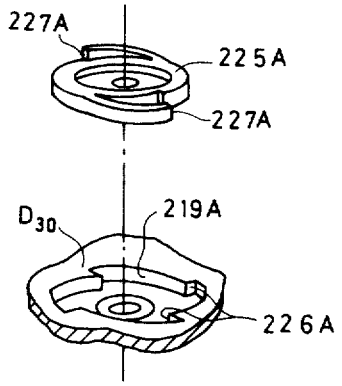
FIG. 12(*a*) is a partially sectional elevational view of a string winder and a guiding means of another embodiment of present invention.
Figure 12:
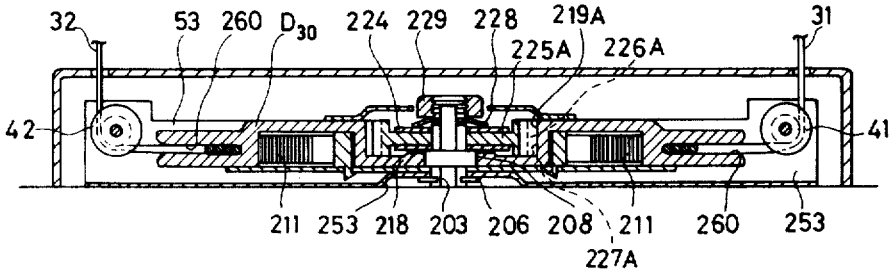

FIG. 12(*a*) is a partially sectional elevation view of a string winder and guiding means of another embodiment of the present invention.

FIG. 12(*b*) is an exploded perspective view of a ratchet part of the example of FIG. 12(*a*). In these drawings, corresponding parts to those of FIGS. 2, 3 and 4 are designated by the same numerals as those, and descriptions thereof are omitted.

In this example of FIG. 12(*a*) and FIG. 12(*b*), the spool $D_{30}$ is shaped very flat like a disk and is journaled by a vertical shaft 203 fixed to a chasis 253. The spool $D_{30}$ has a winding space or groove 260 which is very narrow in the vertical direction of FIG. 12(*a*) and deep in radial direction, and the gap is slightly wider than the diameter of the string 31 or 32. And the wound-in ends of the strings 31 and 32 are fixed at the winding face of the spool $D_{30}$ at 180° apart positions with respect to axis of the spool, so that the strings 31 and 32 are wound in the deep groove 260 forming orderly alternating layers. The spool $D_{30}$ has ratchet hollow 219A at the center part on one face, and the ratchet hollow 219A receives a rotor disk 225A put therein. The ratchet hollow 219A has several ratchets 226A protruding inside the hollow 219A. The rotor disk 225A has spring ratchets 227A on its periphery. The ratchet hollow 219A rotates integrally with the spool $D_{30}$. When the spool $D_{30}$ rotates clockwise, the ratchets 226A of the ratchet hollow 219A engages with the spring ratchets 227A of the rotor disk 225A, thereby the rotor disk 225A is driven. When the spool $D_{30}$ rotates anticlockwise, the ratchets 226A slips off the spring ratchets 227A, and hence the rotor disk 225A is not driven. Therefore, the operation of the winding and veering of the strings 31 and 32 are the same as those of the foregoing examples.

The example of FIG. 12(*a*) and FIG. 12(*b*) is advantageous in its thin structure.

Figure 13:
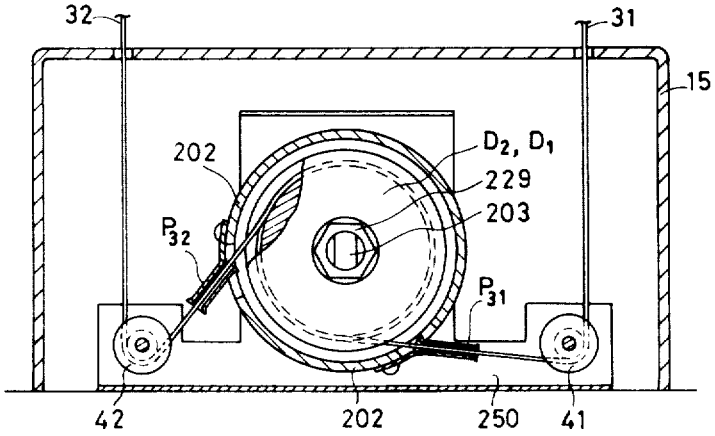
FIG. 13 is a fragmental elevational view of the string winder and the guiding means of another embodiment of present invention.

FIG. 13 is a fragmental elevation view of a string winder and guiding means of another embodiment of the present invention. In the drawing, corresponding parts to those of FIGS. 2, 3 and 4 are designated by the same numerals as those, and description thereof are omitted.

In the example of FIG. 13, the casing 202 is provided with slackening-prevention means consisting of guiding pipes $P_{31}$ and $P_{32}$ for preventing the strings 31 and 32 from irregular winding even at temporary slackening of strings 31 and 32 and orderly single layered winding is obtainable. Therefore, the attitude of the lighting fitting is always maintained in a good order.

Figure 14:
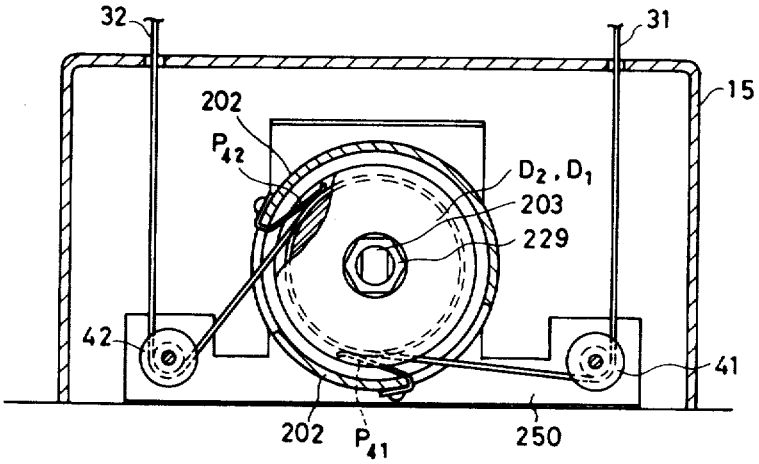
FIG. 14 is a fragmental elevational view of a string winder and a guiding means of another embodiment of present invention.

FIG. 14 is a fragmental elevation view of a string winder and guiding means of another embodiment of the present invention. In FIG. 14, corresponding parts to those of FIGS. 2, 3 and 4 are designated by the same numerals as those, and descriptions thereof are omitted. In FIG. 14, the casing 202 is provided with slackening-prevention means consisting of a flat spring $P_{41}$ and $P_{42}$ for the spools $D_1$ and $D_2$ to press wound faces of the strings 31 and 32, respectively. By means of the flat spring, irregular winding is prevented even at temporary slackening of strings 31 and 32, and orderly single layered winding is obtainable. Therefore, the attitude of the lighting fitting is always maintained in a good order.

Figure 15:
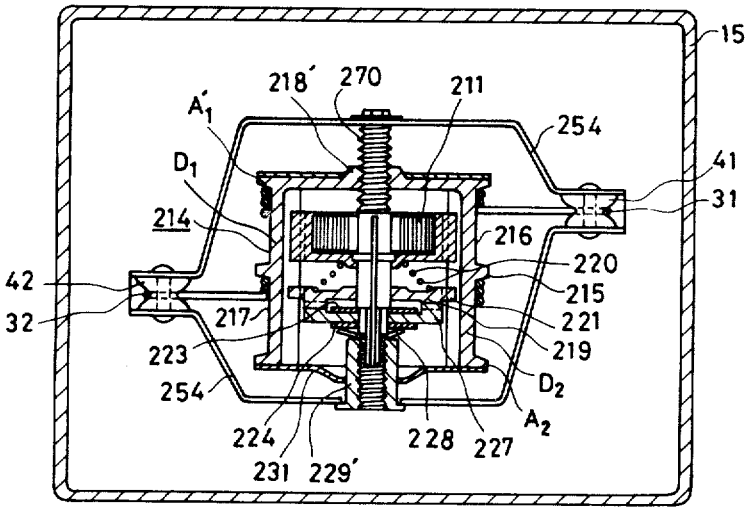
FIG. 15 is a fragmental sectional view of a string winder and a guiding means of another embodiment of present invention.

FIG. 15 is a fragmental elevation view of the string winder and the guiding means of another embodiment of the present invention. In FIG. 15, corresponding parts to those of FIGS. 2, 3 and 4 are designated by the same numerals as those, and descriptions thereof are omitted. In FIG. 15, a monoblock spool 214 is journaled by a screwed shaft 270 which is fixed at least at one end to the chasis 254, and hub 218' of the flange $A_1'$ has a thread which engages said screwed shaft 270. A cylinder-shaped nut 229' which has a long sliding face outside for allowing a through hole of the reinforcing plate 231 to slide axially therealong. When the monoblock spool 214 rotates, it travels along the screwed shaft 270 since threaded hub 218' travels as a result of rotation around the screwed-shaft 270. The pitch of the screw on the shaft 270 is selected in a manner to be substantially equal to that of the winding pitch of the strings 31 and 32 on the spool. By means of such selection, it is possible that the guiding means (i.e., pulleys 41 and 42) come always to the exact front position, where strings 31 and 32 are to be wound in the right order on the face of the spools $D_1$ and $D_2$, respectively, and therefore, the strings 31 and 32 are always wound in a good single aligning order. That is, the screwed shaft 270 and the threaded hub 218' together form a string positioning means.

Figure 16:
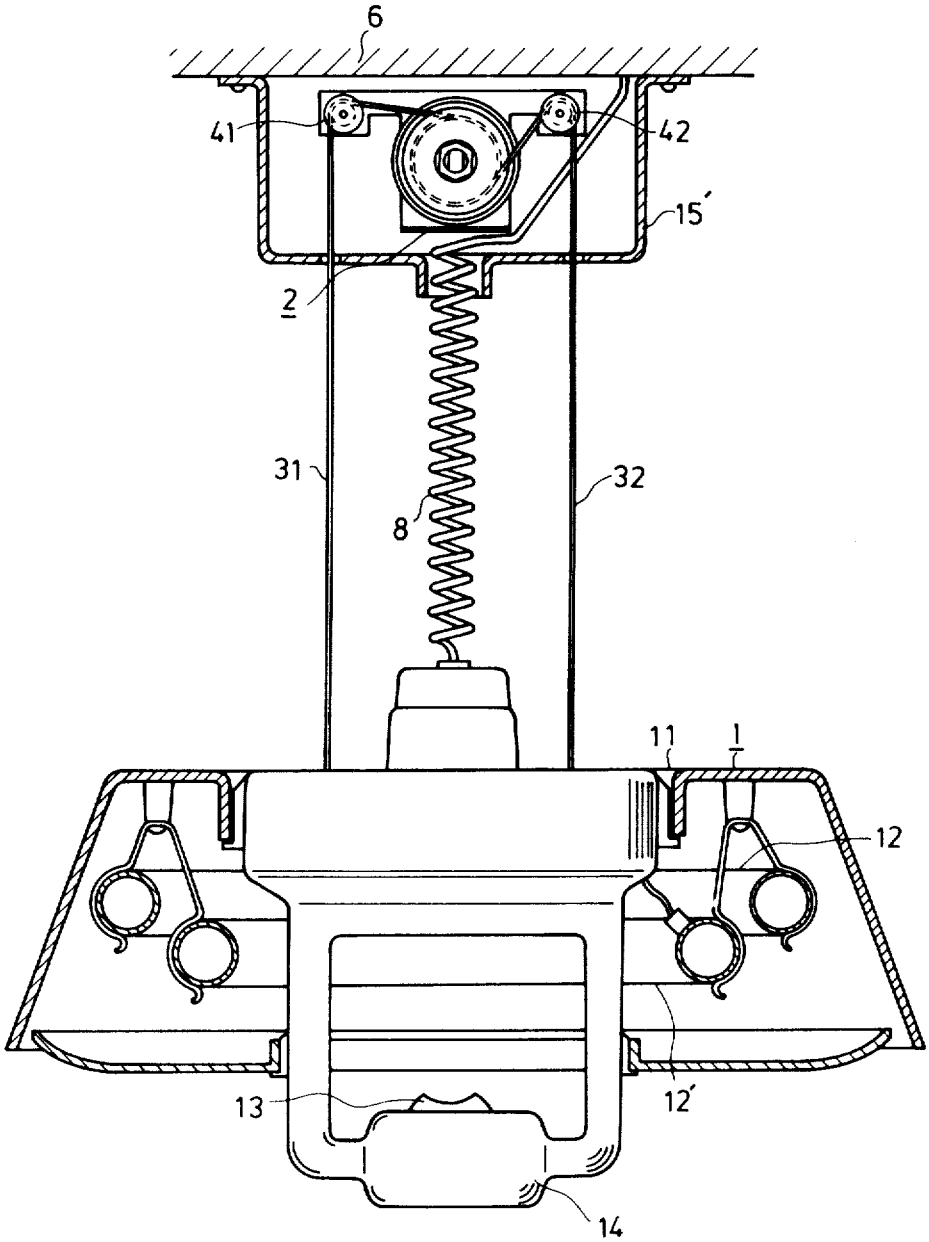
FIG. 16 is an elevational view, partly in cross section, of an example lighting equipment of the present invention.

In the above-mentioned examples, the string winder 2 is fixed on the lighting fitting. But this is not necessary so. FIG. 16 shows an example, where the string winder may be disposed, detached from the lighting fitting 1, on or in the ceiling or beam 6, fixing the other end or fixed end of the strings 31 and 32 on the upper face of the lighting fitting 1. This configuration also can perform the same effect as the preceding examples.

I claim:

1. A lighting equipment of pendant type comprising:

a plural number of strings strung between a principal body of the lighting equipment and a holding means such as a ceiling or a beam from which said principal body of said lighting equipment is to be suspended, a string winder for winding and paying out said plural number of strings in each-other related manner for variation of distance from said holding means to said principal body, said string winder being to be fixed either to said principal body or on said holding means string guiding means for guiding each string and disposed with a predetermined distance from each other, corresponding to said string winder.

2. A lighting equipment in accordance with claim 1, wherein said winder has at least two spools, each of said spools having a drum-shaped winding face corresponding to said strings.

3. A lighting equipment in accordance with claim 2, wherein said winder has at least two spools, and said spools being linked to each other by an interlinking means for linking said spools to rotate in each-other-related manner.

4. A lighting equipment in accordance with claim 3, wherein said spools are coaxially journaled and said interlinking means comprises face gears each fixed on said spools, at least an idler gear inserted between said face gears to interlink said face gears with each other thereby to rotate said spools in opposite directions to each other.

5. A lighting equipment in accordance with claim 3, wherein said winder comprises a winding spring, friction means, and ratchet, which are separately disposed in one of said spools and in the other of said spools.

6. A lighting equipment in accordance with claim 3, wherein said spools are interlinked by a gear means.

7. A lighting equipment in accordance with claim 3, wherein said spools are interlinked by a driving belt.

8. A lighting equipment in accordance with claim 2, wherein said spools are formed as an integrated monoblock body with a separation flange inbetween.

9. A lighting equipment in accordance with claim 2, wherein said spool has a truncated-cone shaped winding face whereon said string guiding means is disposed in front of such a position on said winding surface as is more on the side of larger diameter in comparison with a point on said winding surface to which one end of said string is fixed.

10. A lighting equipment in accordance with claim 2, which further comprises string positioning means for arranging wound string on the winding face of said spool in orderly alignment.

11. A lighting equipment in accordance with claim 2, wherein said winder comprises a slackening prevention means for pressing the wound string for preventing double layered winding.

12. A lighting equipment in accordance with claim 1, wherein said spools are disposed with their shaft in substantially vertical directions and said string guiding means are disposed in a manner to convert the direction of the substantially horizontal strings from said spools to substantially vertical directions.

13. A lighting equipment in accordance with claim 12, wherein one end of said string is fixed on the winding face of said spool at a position is upper than that of said guiding means.

14. A lighting equipment in accordance with claim 12, wherein at least two spools are disposed with their axis in parallel and in close proximity each other, and said guiding means are disposed in a space formed between said spools for compact forming of the winder.

15. A lighting equipment in accordance with claim 1, wherein said winder is disposed apart from a lighting fitting and on said holding means.

16. A lighting equipment in accordance with claim 1, wherein said spool has deep and narrow groove having a gap slightly larger than width of said string for orderly multi-layered single string width winding of said string in said groove.

17. A lighting equipment in accordance with claim 1, wherein said winder comprises:

at least a spool rotatably journaled by a stationary shaft, a winding spring disposed in a space in said spool and connected by one end thereof to said shaft and by the other end thereof to an inner wall of said spool, a slide ratchet disk having ratchets thereon and slidably fitted on said shaft and slidably engaging with said spool in a manner that, in rotation around said shaft, said slide ratchet disk rotates together with said spool, a second ratchet disk having ratchets thereon in a manner to engage with ratchets of said slide ratchet disk, said second ratchet disk being rotatably held by said shaft, a spring for energizing said slide ratchet disk to perform a ratchet operation, and at least a friction means for giving friction force against rotation of said second ratchet disk.

* * * * *